US007766006B1

(12) United States Patent
Manning

(10) Patent No.: US 7,766,006 B1
(45) Date of Patent: Aug. 3, 2010

(54) DUAL FUEL VENT FREE GAS HEATER

(75) Inventor: Steve Manning, Bowling Green, KY (US)

(73) Assignee: Coprecitec, S.L., Aretxabaleta (Gipuzkoa) (ES)

( * ) Notice: Subject to any disclaimer, the term of this patent is extended or adjusted under 35 U.S.C. 154(b) by 46 days.

(21) Appl. No.: 11/684,368

(22) Filed: Mar. 9, 2007

(51) Int. Cl.
*F24H 3/00* (2006.01)

(52) U.S. Cl. ..... 126/99 R; 126/112; 126/117; 126/237; 126/116 R; 432/94

(58) Field of Classification Search ..... 251/88, 251/149.2, 207, 208, 209, 309, 310, 311, 251/149.5, 304; 137/625.19; 122/446; 126/512, 126/112, 117, 237, 99 R, 116 R; 431/125, 431/171, 354, 76; 432/36, 94; 62/48.1
See application file for complete search history.

(56) References Cited

U.S. PATENT DOCUMENTS

| | | | | | |
|---|---|---|---|---|---|
| 962,752 | A | | 6/1910 | Dudgeon | |
| 1,639,780 | A | | 8/1927 | Mulholland | |
| 2,129,231 | A | * | 9/1938 | Parker | 137/625.19 |
| 2,380,956 | A | | 8/1945 | Everts | |
| 2,582,582 | A | * | 1/1952 | Bottom | 431/283 |
| 2,592,132 | A | * | 4/1952 | Simons et al. | 60/39.281 |
| 2,599,872 | A | * | 6/1952 | Slonneger | 251/61.3 |
| 2,608,245 | A | * | 8/1952 | Clark | 431/59 |
| 2,630,821 | A | | 3/1953 | Arey et al. | |
| 2,655,987 | A | * | 10/1953 | Norman, Jr. | 236/91 R |
| 2,661,157 | A | * | 12/1953 | Reichelderfer | 236/91 R |
| 2,687,140 | A | | 8/1954 | St Clair | |
| 2,724,239 | A | * | 11/1955 | Fox | 60/39.281 |
| 2,750,997 | A | * | 6/1956 | Reuter | 431/284 |
| 2,826,213 | A | * | 3/1958 | Wright | 137/116.3 |
| 2,863,498 | A | * | 12/1958 | Rogers et al. | 431/279 |
| 2,867,234 | A | * | 1/1959 | Billington | 137/505.11 |
| 3,001,541 | A | | 9/1961 | Clair | |
| 3,082,305 | A | * | 3/1963 | Wunder | 337/95 |
| 3,139,879 | A | | 7/1964 | Bauer et al. | |

(Continued)

FOREIGN PATENT DOCUMENTS

| | | |
|---|---|---|
| DE | 720854 | 5/1942 |

(Continued)

OTHER PUBLICATIONS

Style Selections; Vent-Fee Fireplace; Model SSID280T; US.

(Continued)

*Primary Examiner*—Kenneth B Rinehart
*Assistant Examiner*—Jorge Pereiro
(74) *Attorney, Agent, or Firm*—Tim L. Kitchen; Peter B. Scull; Kristina M. Kalan

(57) ABSTRACT

A dual fuel vent free gas heater having at least one gas burner with a plurality of gas outlet ports in an upper surface thereof. The gas outlet ports are in flow communication with at least one pilot flame burner. An adjustable fuel injector or at least two fuel injectors feed fuel to the burner providing for introduction of more than one fuel to the burner. Optionally, an oxygen detection system, manual fuel selection control valve, and/or temperature shut off control system may be incorporated into the dual fuel vent free heater.

13 Claims, 10 Drawing Sheets

U.S. PATENT DOCUMENTS

| | | | | | |
|---|---|---|---|---|---|
| 3,265,299 | A | * | 8/1966 | Rice et al. | 236/21 B |
| 3,285,319 | A | * | 11/1966 | Hartline | 431/263 |
| 3,295,585 | A | | 1/1967 | Kovack, Jr. et al. | |
| 3,331,392 | A | | 7/1967 | Davidson et al. | |
| 3,469,590 | A | * | 9/1969 | Barker | 137/1 |
| 3,590,806 | A | | 7/1971 | Locke | |
| 3,595,270 | A | * | 7/1971 | McNeal, Jr. | 137/575 |
| 3,706,303 | A | | 12/1972 | Hapgood | |
| 3,747,586 | A | | 7/1973 | Weiss | |
| 3,814,573 | A | | 6/1974 | Karlovetz | |
| 3,817,686 | A | | 6/1974 | Quittner | |
| 3,829,279 | A | * | 8/1974 | Qualley et al. | 431/354 |
| D243,694 | S | | 3/1977 | Faulkner | |
| 4,020,870 | A | | 5/1977 | Carlson | |
| 4,134,719 | A | * | 1/1979 | Velie | 431/171 |
| 4,202,180 | A | * | 5/1980 | Cox | 62/48.1 |
| 4,290,450 | A | | 9/1981 | Swanson | |
| 4,340,362 | A | | 7/1982 | Chalupsky et al. | |
| 4,348,172 | A | | 9/1982 | Miller | |
| 4,355,659 | A | * | 10/1982 | Kelchner | 137/625.19 |
| 4,640,674 | A | | 2/1987 | Kitchen | |
| 4,640,680 | A | | 2/1987 | Schilling | |
| 4,651,711 | A | | 3/1987 | Velie | |
| 4,718,448 | A | | 1/1988 | Love et al. | |
| 4,718,846 | A | | 1/1988 | Oguri et al. | |
| 4,765,146 | A | * | 8/1988 | Hellat et al. | 60/746 |
| 4,768,543 | A | | 9/1988 | Wienke et al. | |
| 4,768,947 | A | | 9/1988 | Adachi | |
| 4,773,255 | A | * | 9/1988 | Malcosky et al. | 73/40.7 |
| 4,776,730 | A | * | 10/1988 | Nearen et al. | 406/124 |
| 4,779,643 | A | | 10/1988 | Genbauffe | |
| 4,782,814 | A | | 11/1988 | Cherryholmes | |
| 4,848,313 | A | | 7/1989 | Velie | |
| 4,930,538 | A | | 6/1990 | Browne | |
| 4,962,749 | A | | 10/1990 | Dempsey et al. | |
| 4,965,707 | A | | 10/1990 | Butterfield | |
| 5,005,493 | A | * | 4/1991 | Gitman | 110/246 |
| 5,039,007 | A | * | 8/1991 | Wolter | 236/12.1 |
| 5,090,899 | A | | 2/1992 | Kee | |
| 5,131,425 | A | * | 7/1992 | Sturgis | 137/116.5 |
| 5,172,728 | A | | 12/1992 | Tsukazaki | |
| 5,199,385 | A | * | 4/1993 | Doss | 122/14.22 |
| 5,201,651 | A | | 4/1993 | Niksic et al. | |
| 5,239,973 | A | | 8/1993 | Murata et al. | |
| 5,239,979 | A | | 8/1993 | Maurice et al. | |
| 5,251,823 | A | | 10/1993 | Joshi et al. | |
| 5,304,059 | A | * | 4/1994 | Tanaka et al. | 431/170 |
| 5,314,007 | A | * | 5/1994 | Christenson | 165/43 |
| 5,393,222 | A | | 2/1995 | Sutton | |
| 5,413,141 | A | | 5/1995 | Dietiker | |
| 5,452,709 | A | | 9/1995 | Mealer | |
| 5,470,018 | A | | 11/1995 | Smith | |
| 5,503,550 | A | | 4/1996 | DePalma | |
| 5,513,798 | A | | 5/1996 | Tavor | |
| 5,526,758 | A | * | 6/1996 | Giammaruti et al. | 110/263 |
| 5,542,609 | A | | 8/1996 | Myers et al. | |
| 5,553,603 | A | | 9/1996 | Barudi et al. | |
| 5,567,141 | A | | 10/1996 | Joshi et al. | |
| 5,575,274 | A | | 11/1996 | DePalma | |
| 5,577,708 | A | * | 11/1996 | Pfannenschmidt | 251/315.11 |
| 5,584,680 | A | | 12/1996 | Kim | |
| 5,603,211 | A | | 2/1997 | Graves | |
| 5,642,580 | A | | 7/1997 | Hess et al. | |
| 5,645,043 | A | | 7/1997 | Long et al. | |
| 5,674,065 | A | | 10/1997 | Grando et al. | |
| D391,345 | S | | 2/1998 | Mandir et al. | |
| 5,738,084 | A | | 4/1998 | Hussong | |
| 5,782,626 | A | | 7/1998 | Joos et al. | |
| 5,807,098 | A | | 9/1998 | Deng | |
| 5,814,121 | A | | 9/1998 | Travis | |
| 5,838,243 | A | | 11/1998 | Gallo | |
| 5,839,428 | A | | 11/1998 | Schroeter et al. | |
| 5,906,197 | A | | 5/1999 | French et al. | |
| 5,915,952 | A | | 6/1999 | Manning et al. | |
| 5,941,699 | A | | 8/1999 | Abele | |
| 5,966,937 | A | | 10/1999 | Graves | |
| 5,975,112 | A | | 11/1999 | Ohmi et al. | |
| 5,984,662 | A | | 11/1999 | Barudi et al. | |
| 5,987,889 | A | | 11/1999 | Graves et al. | |
| 5,988,204 | A | | 11/1999 | Reinhardt et al. | |
| 6,035,893 | A | | 3/2000 | Ohmi et al. | |
| 6,041,622 | A | * | 3/2000 | Duchateau et al. | 65/134.4 |
| 6,045,058 | A | | 4/2000 | Dobbeling et al. | |
| 6,068,017 | A | | 5/2000 | Haworth et al. | |
| 6,076,517 | A | | 6/2000 | Kahlke et al. | |
| 6,113,389 | A | * | 9/2000 | Joshi et al. | 432/180 |
| 6,170,507 | B1 | | 1/2001 | Dalton et al. | |
| 6,192,913 | B1 | | 2/2001 | Willey et al. | |
| 6,197,195 | B1 | * | 3/2001 | Booth et al. | 210/340 |
| 6,227,194 | B1 | | 5/2001 | Barudi et al. | |
| 6,227,451 | B1 | | 5/2001 | Caruso | |
| 6,244,524 | B1 | | 6/2001 | Tackels et al. | |
| 6,257,230 | B1 | | 7/2001 | Barudi et al. | |
| 6,257,270 | B1 | | 7/2001 | Ohmi et al. | |
| 6,257,871 | B1 | * | 7/2001 | Weiss et al. | 431/20 |
| 6,264,466 | B1 | * | 7/2001 | Joshi et al. | 432/180 |
| 6,308,739 | B1 | * | 10/2001 | Barbuto et al. | 137/625.19 |
| 6,321,779 | B1 | | 11/2001 | Miller et al. | |
| 6,340,298 | B1 | | 1/2002 | Vandrak et al. | |
| 6,354,072 | B1 | | 3/2002 | Hura | |
| 6,443,130 | B1 | | 9/2002 | Turner et al. | |
| 6,541,729 | B2 | * | 4/2003 | Siniaguine | 219/121.54 |
| 6,543,235 | B1 | | 4/2003 | Crocker et al. | |
| 6,571,615 | B1 | * | 6/2003 | Meyer et al. | 73/114.77 |
| 6,638,061 | B1 | * | 10/2003 | Cain et al. | 432/14 |
| 6,648,635 | B2 | | 11/2003 | Vandrak et al. | |
| 6,699,031 | B2 | * | 3/2004 | Kobayashi et al. | 431/10 |
| 6,705,342 | B2 | | 3/2004 | Santinanavat et al. | |
| 6,792,799 | B2 | * | 9/2004 | Ford | 73/202 |
| 6,880,549 | B2 | | 4/2005 | Topp | |
| 6,884,065 | B2 | | 4/2005 | Vandrak et al. | |
| 6,904,873 | B1 | | 6/2005 | Ashton | |
| 6,938,634 | B2 | | 9/2005 | Dewey, Jr. | |
| 6,982,006 | B1 | * | 1/2006 | Boyers et al. | 134/3 |
| 7,044,729 | B2 | | 5/2006 | Ayastuy et al. | |
| 7,251,940 | B2 | | 8/2007 | Graves et al. | |
| 7,300,278 | B2 | | 11/2007 | Vandrak et al. | |
| 7,316,207 | B2 | * | 1/2008 | Jenkins et al. | 123/25 B |
| 7,434,447 | B2 | | 10/2008 | Deng | |
| 7,607,426 | B2 | * | 10/2009 | Deng | 126/116 A |
| 2001/0037829 | A1 | | 11/2001 | Shaw et al. | |
| 2002/0058266 | A1 | | 5/2002 | Clough et al. | |
| 2002/0160325 | A1 | | 10/2002 | Deng | |
| 2002/0160326 | A1 | | 10/2002 | Deng | |
| 2003/0168102 | A1 | | 9/2003 | Santinanavat et al. | |
| 2003/0192377 | A1 | * | 10/2003 | Ford | 73/202 |
| 2003/0192591 | A1 | | 10/2003 | Strom | |
| 2003/0198908 | A1 | | 10/2003 | Berthold et al. | |
| 2004/0096790 | A1 | | 5/2004 | Querejeta et al. | |
| 2004/0238029 | A1 | | 12/2004 | Haddad | |
| 2004/0238030 | A1 | | 12/2004 | Dewey, Jr. | |
| 2005/0175944 | A1 | | 8/2005 | Ahamady | |
| 2006/0057517 | A1 | * | 3/2006 | Joshi et al. | 431/12 |
| 2007/0224558 | A1 | | 9/2007 | Flick et al. | |
| 2007/0266765 | A1 | | 11/2007 | Deng | |
| 2007/0277803 | A1 | | 12/2007 | Deng | |
| 2007/0277812 | A1 | | 12/2007 | Deng | |
| 2007/0277813 | A1 | | 12/2007 | Deng | |
| 2008/0149871 | A1 | | 6/2008 | Deng | |
| 2008/0149872 | A1 | | 6/2008 | Deng | |
| 2008/0153044 | A1 | | 6/2008 | Deng | |
| 2008/0153045 | A1 | | 6/2008 | Deng | |
| 2008/0223465 | A1 | | 9/2008 | Deng | |

2008/0227045 A1 9/2008 Deng

FOREIGN PATENT DOCUMENTS

| | | | |
|---|---|---|---|
| ES | U200800992 | | 7/2008 |
| GB | 2319106 | A | 5/1998 |
| GB | 2330438 | A | 4/1999 |
| JP | 58219320 | | 12/1983 |
| JP | 03230015 | | 10/1991 |
| JP | 2003056845 | | 2/2003 |
| JP | 2003074837 | | 3/2003 |
| JP | 2003074838 | | 3/2003 |
| WO | WO0050815 | A1 | 8/2000 |

OTHER PUBLICATIONS

Confort Glow; Vent-Free Gas Space Heaters; Ultra Slim.
Confort Glow; Vent-Free Gas Space Heaters; Solarfusion.
Glo-Warm; Blue Flame Vent-Free Gas Space Heaters.
Reddyheater; Garage Heaters; The Outdoorsman.
Vanguard; Single Burner 26" Compact; Dual Burner 26" Compact; Classic Hearth 32"; Classic Pro 36".
Vent-Free Gas Log Heaters; Blaze N' Glow Oak.
Vanguard; Cast Iron Gas Stove Heaters.
Vanguard; Vent-Free Gas Space Heaters.
Hearth Sense; Dual Fuel.
Napoleon, The Madison Installation and Operation Instructions, May 24, 2005.
Napoleon; Park Avenue Installation and Operation Instructions; Jul. 20, 2006.
Heat and Glo; Escape Series Gas Fireplaces; Mar. 2005.
Heat and Glo; Ower's Manual; Escape-42DV; Dec. 2006.

* cited by examiner

DUAL FUEL VENT FREE GAS HEATER

CROSS-REFERENCE TO RELATED APPLICATIONS

Not applicable

BACKGROUND OF THE INVENTION

1. Field of the Invention

The present invention relates generally to gas heaters and, more particularly, to unvented gas heaters.

2. Description of the Related Art

Unvented gas heaters are designed to be used indoors without pipes, ducts, or other conduit to vent the heater's exhaust to the exterior atmosphere. Vent free gas heaters typically include one or more gas burners and optionally one or more ceramic containing heating elements in a housing. The gas and air mix in the heater where combustion takes place. These heaters may have a blower to force air flow through the heater providing the release of heated gases or convective heat.

Unvented gas heaters have been designed to be free standing, mounted on a wall, or in a decorative housing such as a vent free fireplace. The housing providing a vent free fireplace is typically substantially the size of a fireplace and has artificial logs above the burners. Some have even been designed with a glass front to provide the appearance of an enclosed fireplace.

The unvented heaters of the prior art are typically designed to use either natural gas or liquid propane gas as a fuel source. It is not permitted for a manufacturer to supply a conversion kit for an unvented gas heater to convert from one fuel source to another. Even if such a conversion kit were permitted, as is the case with vented gas heaters, to change fuel source gas type on a heater in the field, requires the installer to change the regulator, pilot orifice and burner orifice for the alternate gas type.

SUMMARY OF THE INVENTION

A dual fuel gas burner is provided for use in a vent free heater. Embodiments of the dual fuel vent free gas burner can be used in free standing heaters, wall mount heaters, gas fireplaces, or other vent free heaters as is known in the art. A dual fuel vent free gas heater provides convective and/or radiant heat preferably to an indoor environment. The heater may be designed to use natural convective air currents and may optionally have a fan enhancing the natural convective currents within the heater. Alternatively, a fan may be used to force the gases and/or air within the heater at desired flow patterns which may be counter to natural convective forces.

This gas heater can be operated with multiple fuels such as liquid propane or natural gas. In some embodiments, an installer turns a selector valve plumbed in the product gas train. This selection sends the correct gas type to the correct fuel injector and pilot burner. Preferably, all plumbing connections are performed at the factory rather than onsite by the user or installer.

Embodiments of the gas heater can be operated on liquid propane or natural gas by connecting the fuel supply to the correct regulator on the heater. The installer or user then turns a selector valve, in selected embodiments, plumbed in the product gas train. This selection sends the correct gas type to the correct injector and pilot burner for the supply gas. Optionally, an oxygen detection system is incorporated within the heater. Advantageously, the heater is thermostatically controlled.

DETAILED DESCRIPTION OF THE PREFERRED EMBODIMENTS

The following description describes embodiments of a dual fuel vent free heater. In the following description, numerous specific details and options are set forth in order to provide a more thorough understanding of the present invention. It will be appreciated, however, by one skilled in the art that the invention may be practiced without such specific details or optional components and that such descriptions are merely for convenience and that such are selected solely for the purpose of illustrating the invention. As such, reference to the figures showing embodiments of the present invention is made to describe the invention and not to limit the scope of the disclosure and claims herein.

Figure 1:
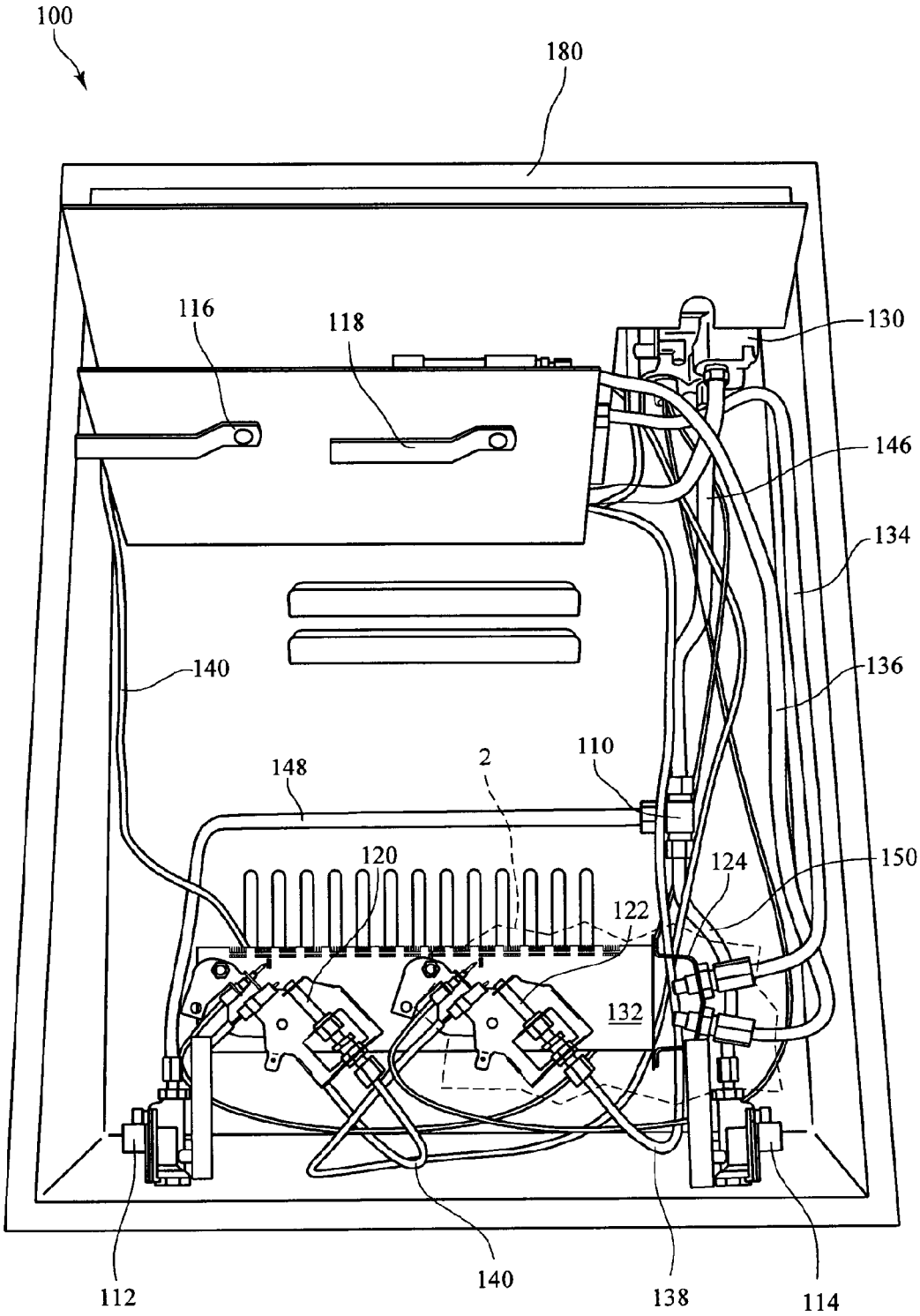
FIG. 1 is a front perspective view of an embodiment of a dual fuel vent free heater showing heater components thereof assembled within a housing.
Figure 2:
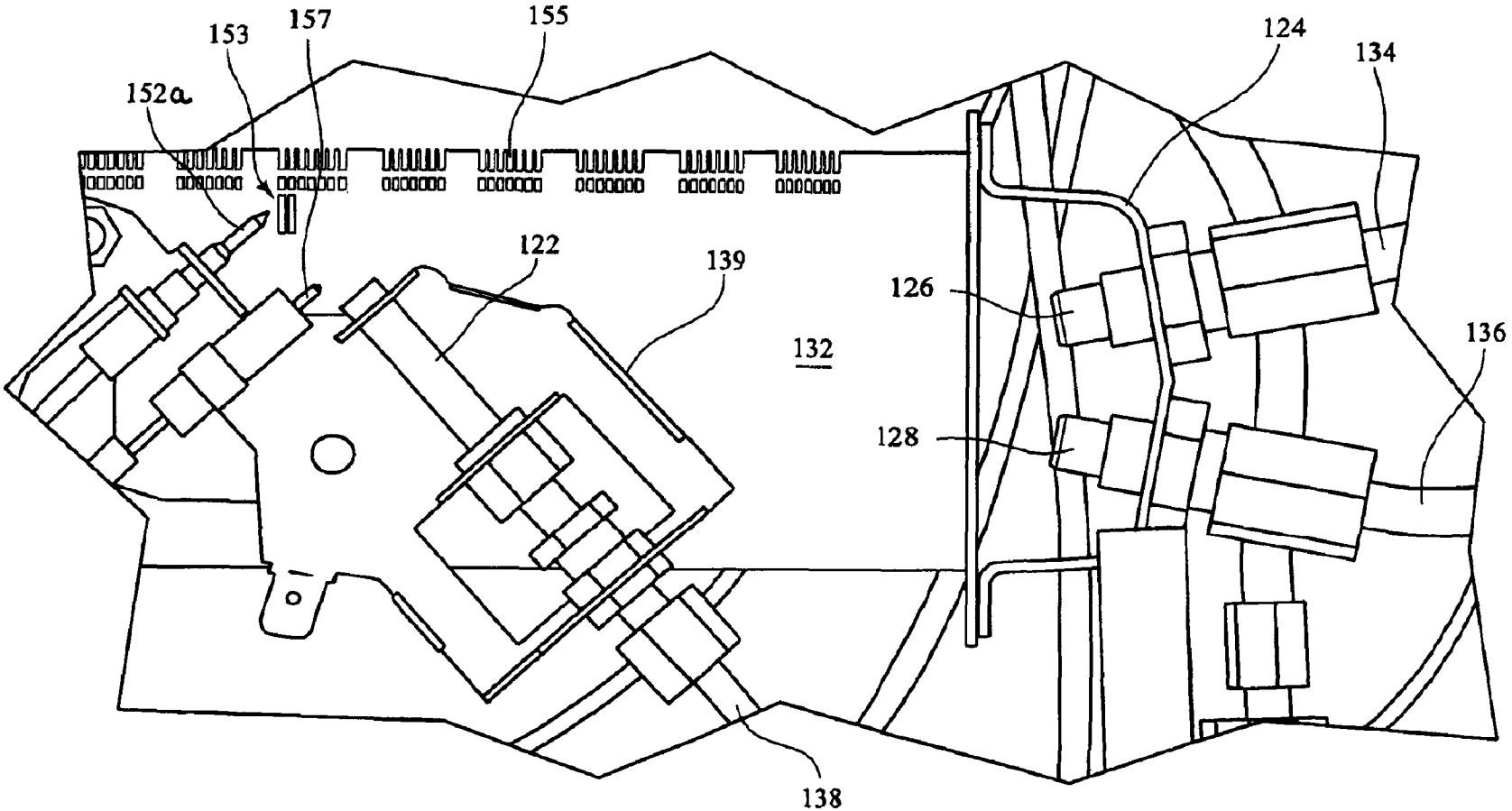
FIG. 2 is a cut-away view of the dual fuel vent free heater of FIG. 1 showing an oxygen detection system.
Figure 3:
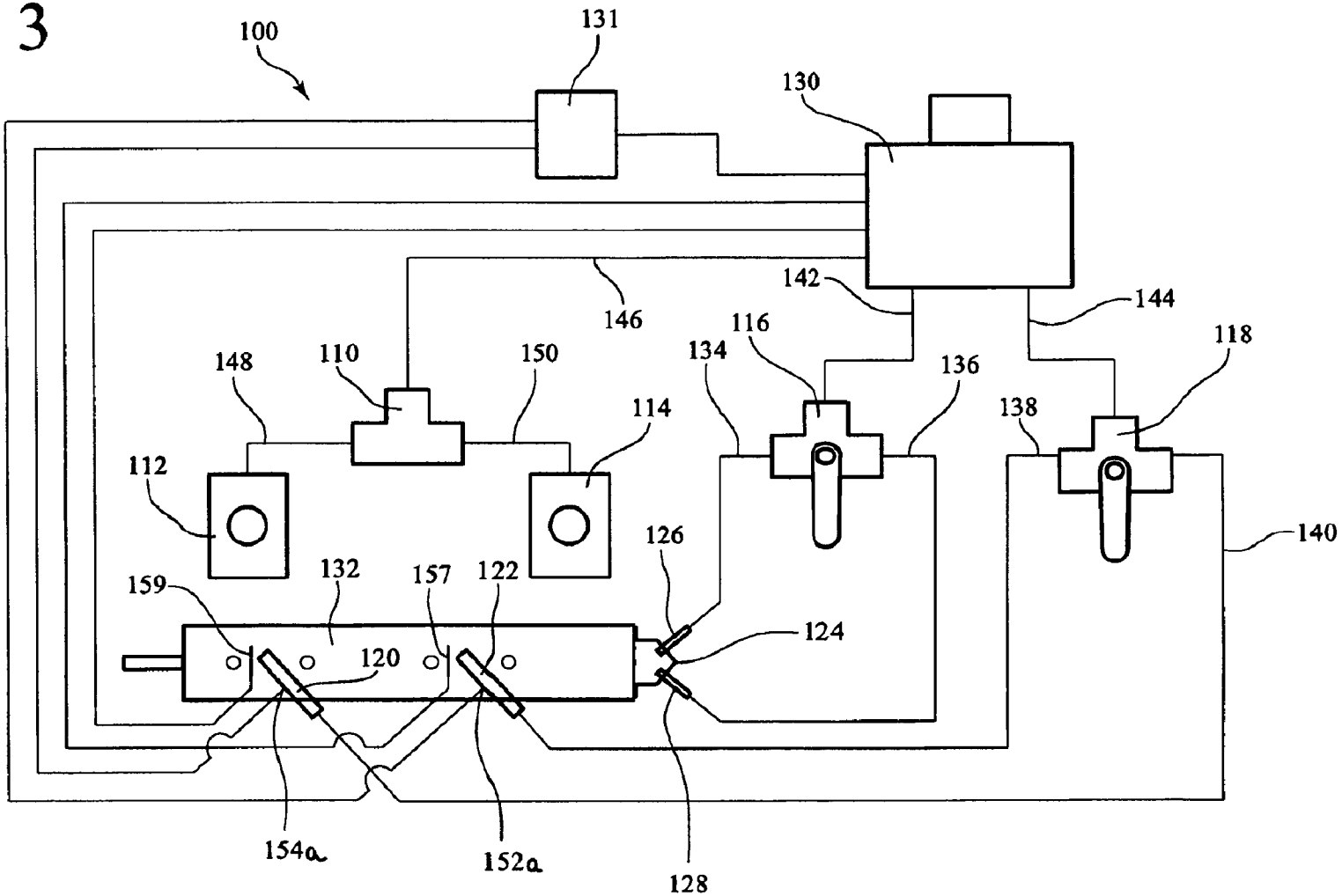
FIG. 3 is schematic view of the dual fuel vent free heater of FIG. 1 showing flow connection of component parts.

FIGS. 1, 2 and 3 show dual fuel vent free heater 100. FIG. 1 shows the component parts of dual fuel vent free heater 100 in a housing 180 and FIG. 3 shows the flow diagram of heater 100. Dual fuel vent free gas heater 100 comprises a gas burner 132 having a plurality of gas outlet ports 155 (shown in FIG. 2) in an upper surface thereof. It is to be understood that outlet ports 155 may be in a side and/or lower surface of gas burner 132 and gas burner 132 may be situated vertically or angled within housing 180 and still be within the scope of this invention. Gas outlet ports 155 are in flow communication with pilot flame burners 120 and 122. Brackets 139 hold pilot flame burners 120 and 122, piezometric igniters 157 and 159, and temperature sensors 152 and 154 proximate burner 132. Piezometric igniters 157 and 159 are adjacent to pilot flame burners 122 and 120 respectively. Fuel injectors 126 and 128 are in flow communication with the interior portion of gas burner 132. Bracket 124 holds fuel injectors 126 and 128 at an injection angle with respect to a longitudinal axis of gas burner 132 other then 0°. Injectors 126 and 128 are non-concentrically aligned with a burner venturi within burner 132. Bracket 124 controls the angle of each injector with the axis of the burner or venturi. This angle may be varied depending on the size of the burner. Optionally, an oversized venturi may accommodate non-concentric injectors 126 and 128. Preferably, bracket 124 has threaded apertures for accommodation of injectors having a threaded outer annular surface. Preferably, the injection angle of each injector is of the same magnitude. Fuel supply lines 134 and 136 are in flow communication with fuel injectors 126 and 128 respectively. Fuel supply line 134 and injector 126 have a composition and configuration for transporting a fuel such as natural gas or liquid propane at a desired flow rate and fuel supply line 136 and injector 128 have a composition and configuration for transporting a different fuel such as either of natural gas or liquid propane at a desired flow rate.

FIG. 2 is a cutaway portion of dual fuel vent free heater 100 showing an oxygen detection system. Oxygen detection control system 131, shown schematically in FIG. 3, is in electronic communication with temperature sensors 152*a* and 154*a* and thermostatic control 130 wherein thermostatic control 130 has valves controlling the flow of fuels to injectors 126 and 128 and pilot flame burners 120 and 122. Oxygen detection control system 131 sends an electronic signal to thermostatic control 130 directing thermostatic control 130 to close the valves shutting off the flow of fuel when a temperature sensor 152*a* or 154*a* indicates a temperature less than a control temperature thereby indicating a low oxygen level condition.

Dual fuel vent free gas heater 100 comprises two regulators 112 and 114 in flow communication with "T" connector 110 via fuel lines 148 and 150 respectively. Fuel line 146 extends from "T" connector 110 to thermostatic control valve 130. Pilot line 144 leads from thermostatic control valve 130 to pilot control valve 118. Injector line 142 leads from thermostatic control valve 130 to injector control valve 116. Fuel lines 138 and 140 lead from pilot control valve 118 to pilot flame burners 122 and 120 respectively. Fuel lines 136 and 134 lead from injector control valve 116 to injectors 126 and 128 respectively. Control valves 118 and 116 are manually adjusted for the fuel type being connected to regulator 112 or 114. Typically control valves 118 and 116 each have a setting for natural gas and a setting for liquid propane gas and are adjusted according to the fuel connected to regulator 112 or 114.

Figure 4:
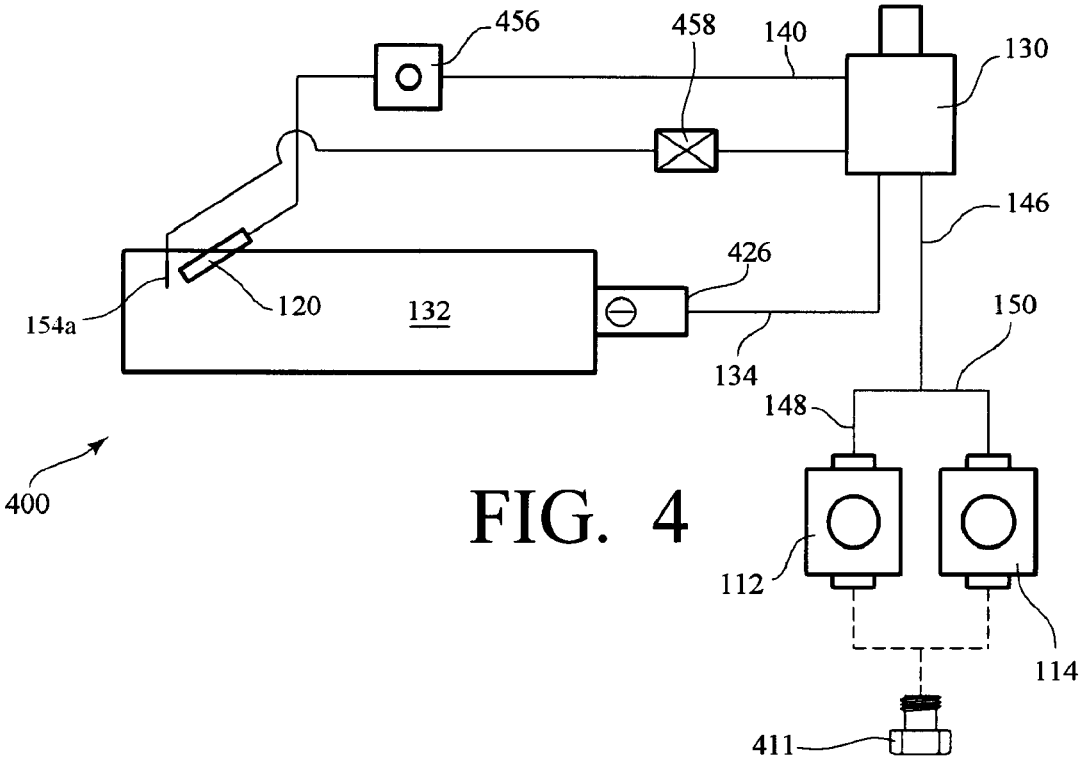
FIG. 4 is schematic view of a dual fuel vent free heater having a single multiuse injector and a thermal switch.

FIG. 4 shows a schematic view of dual fuel vent free heater 400 having a single burner 132 and a thermal switch 458. Gas burner 132 has a plurality of gas outlet ports. Fuel injector 426 is in flow communication with fuel supply line 134 and an interior of gas burner 132. Fuel injector 426 has a manual control valve therein for controlling the flow of a fuel to burner 132. Injector 426 has at least two settings for adjustment to alternate between at least two different fuels being fed from regulator 112 or regulator 114 through fuel supply line 134. Fuel supply line 134 is in flow communication with thermostat control 130. Fuel line 140 is in flow communication with thermostat control 130 and pilot burner 120 and has regulator 456 inline therewith. Regulators 114 and 112 each have back flow prevention systems or a plug 411 in allowing a single fuel tank to be connected to either regulator leaving the other regulator without a fuel source. Regulators 112 and 114 are each in flow communication with a "T" connector via fuel lines 148 and 150 respectively. Fuel inlet line 146 extends from the "T" connector and feeds into thermostat control valve 130. Thermal switch 458 is in electronic communication with thermostat control valve 130 and temperature sensor 154*a*. Temperature sensor 154*a* is in proximity to pilot burner 120 and primary burner 132 as shown. Thermal switch 458 sends an electronic signal to thermostat control valve 130 shutting off fuel flow to fuel supply line 134 and pilot burner supply line 140 in the event that an incorrect setting is made with injector 426 with respect to the fuel being fed to regulator 112 or 114 by measuring a high temperature condition via temperature sensor 154*a* at burner 132.

Figure 5:
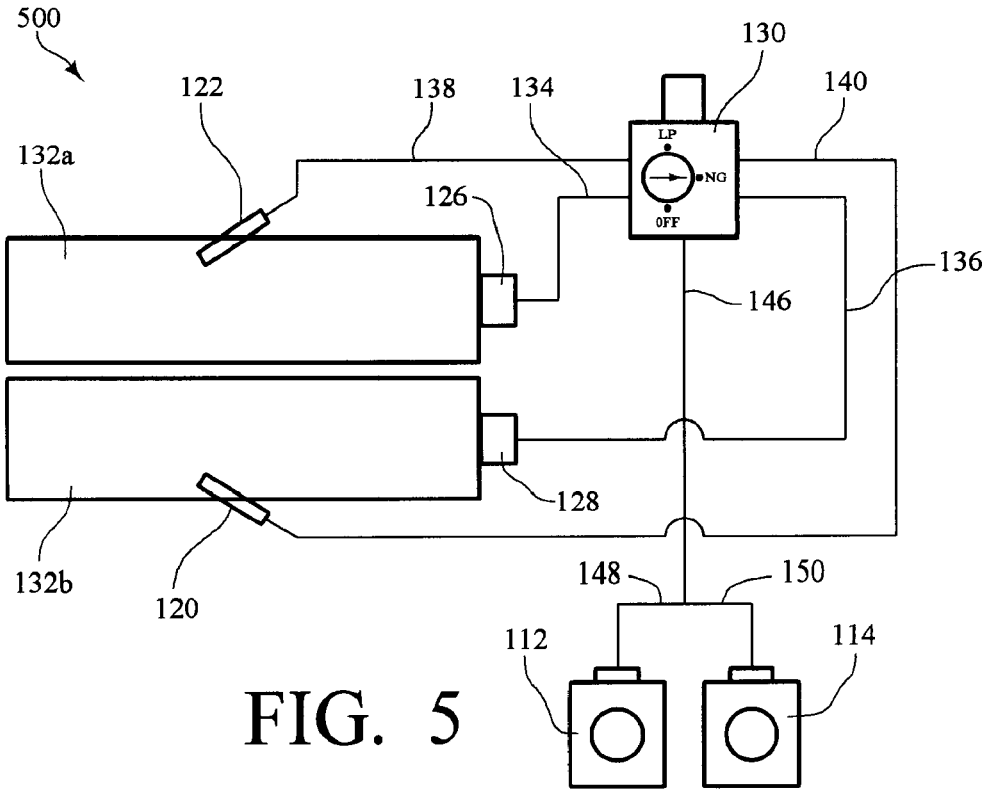
FIG. 5 is schematic view of a dual fuel vent free heater having a dual burner configuration.

FIG. 5 shows dual fuel vent free heater 500 having a dual burner configuration. Two regulators 112 and 114 are in flow communication with a "T" connector via fuel lines 148 and 150 respectively. Fuel line 146 extends from the "T" connector to thermostatic control valve 130. Pilot burner supply lines 138 and 140 lead from control valve 130 to pilot flame burners 122 and 120 respectively. Fuel injector lines 134 and 136 lead from thermostatic control valve 130 to injectors 126 and 128 respectively. Burner 132*a* has first pilot flame burner 122 proximate gas outlet apertures therein and injector 126 proximate an axial opening. Burner 132*b* has pilot flame burner 120 proximate gas outlet apertures and injector 128 proximate an axial opening therein.

Figure 6:
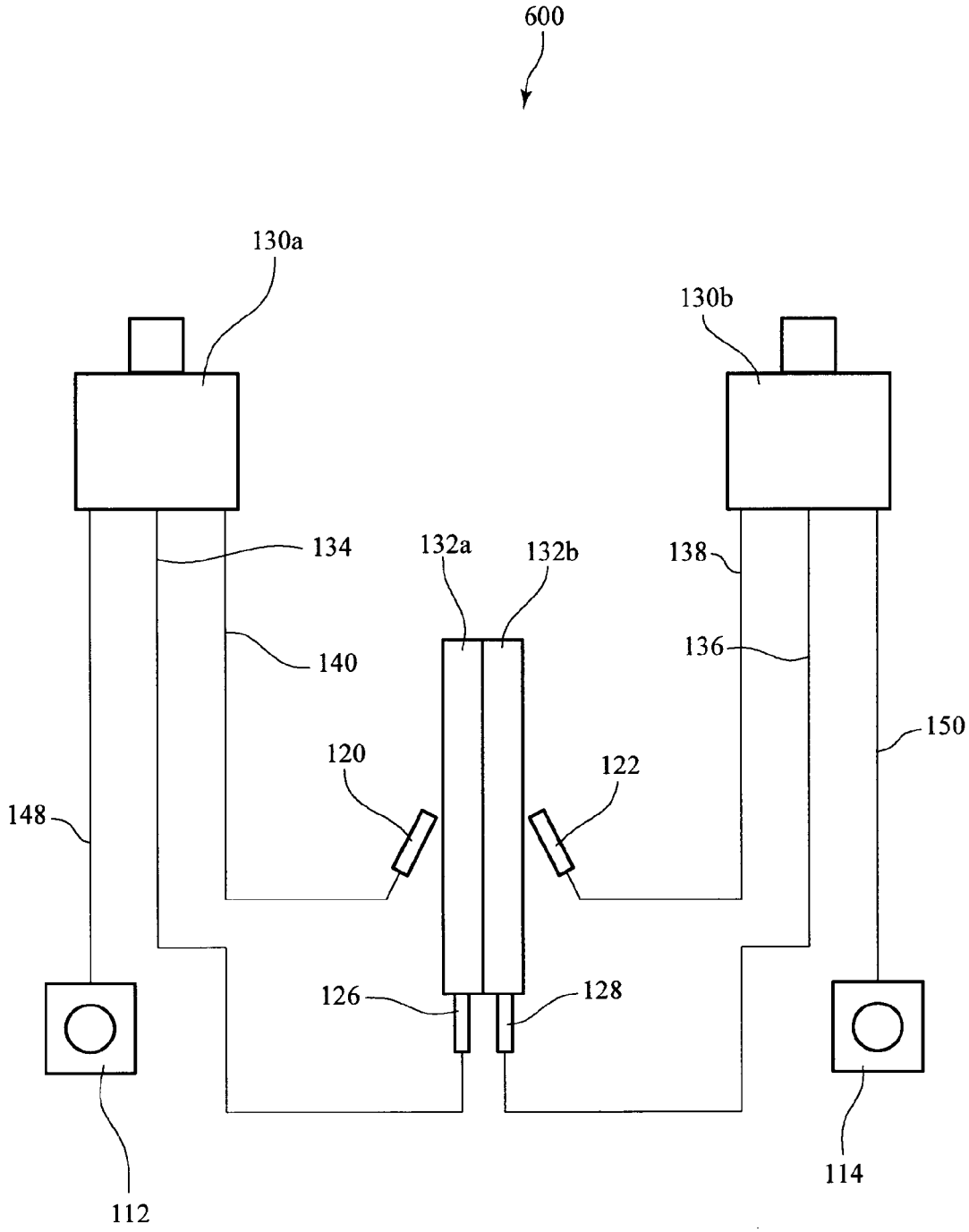
FIG. 6 is schematic view of a dual fuel vent free heater having a dual burner and dual thermostatic control valve configuration.

FIG. 6 is a schematic view of a dual fuel vent free heater 600 having a dual burner and dual thermostatic control valve configuration. Regulator 112 is in flow communication with control valve 130*a* via fuel line 148. Regulator 114 is in flow communication with control valve 130*b* via fuel line 150. Pilot supply line 140 leads from control valve 130*a* to pilot flame burner 120 and pilot supply line 138 leads from control valve 130*b* to pilot flame burner 122. Injector supply line 134 leads from control valve 130*a* to fuel injector 126. Injector supply line 136 leads from control valve 130*b* to fuel injector 128. Burner 132*a* has pilot flame burner 120 proximate gas outlet apertures and fuel injector 126 proximate an axial opening. Burner 132*b* has pilot flame burner 122 proximate gas outlet apertures and fuel injector 128 proximate an axial opening therein.

Figure 7:
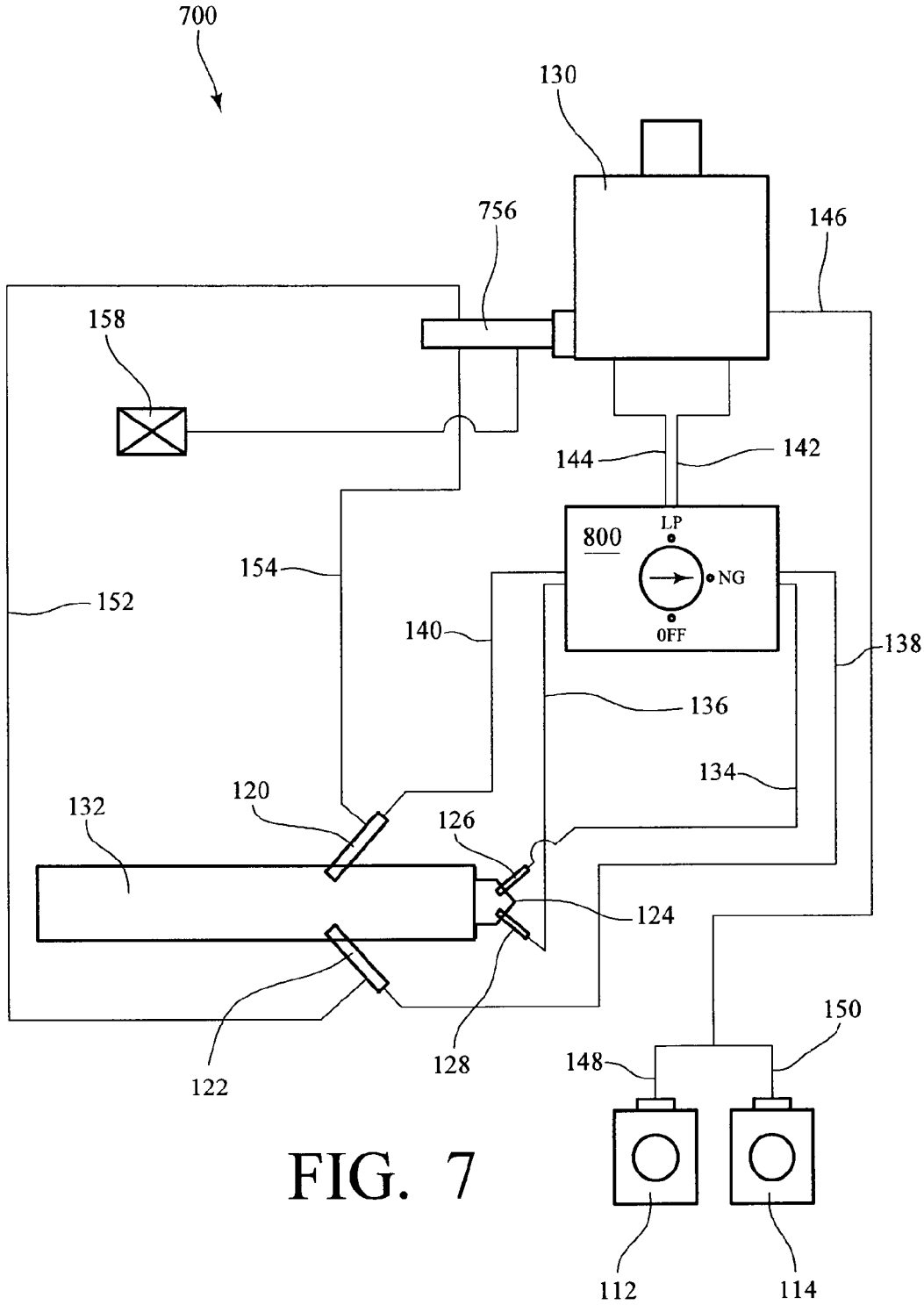
FIG. 7 is a schematic view of a dual fuel vent free heater having a multi-positional manual control valve, a thermal switch, and a thermostatic control valve.

FIG. 7 shows a schematic view of dual fuel vent free heater 700 having a multi-positional manual control valve 800. Regulators 112 and 114 are in flow communication with a "T" connector via fuel lines 148 and 150 respectively. Fuel line 146 extends from the "T" connector to thermostatic control valve 130. Pilot line 142 and injector line 144 lead from thermostatic control valve 130 to multi-positional manual control valve 800. Multi-positional manual control valve 800 directs flow from pilot line 142 and injector line 144 to pilot supply line 140 and injector supply line 136, or pilot supply line 138 and injector supply line 134, or blocks the flow from pilot line 142 and injector line 144. Burner 132 has injectors 126 and 128 held at an angle to the burner axis in proximity to the burner opening with bracket 124. Pilot burners 120 and 122 are proximate the outer surface of burner 132 and are in flow communication with pilot supply line 140 and 138 respectively. Thermal switch 158 is in electronic communication with T/C block 756. T/C block 756 is in electronic communication with a thermocouple 152*a*, 154*a* proximate each pilot burner 120 and 122 and primary burner 132, via T/C lines 154 and 152, and control valve 130. In the event an incorrect setting is made with respect to the fuel being fed to the correct injector and pilot burner, thermal switch 158 or control valve 130 shuts off the flow of gas to heater 700 by reading of a high temperature condition near burner 132.

Figure 8B:
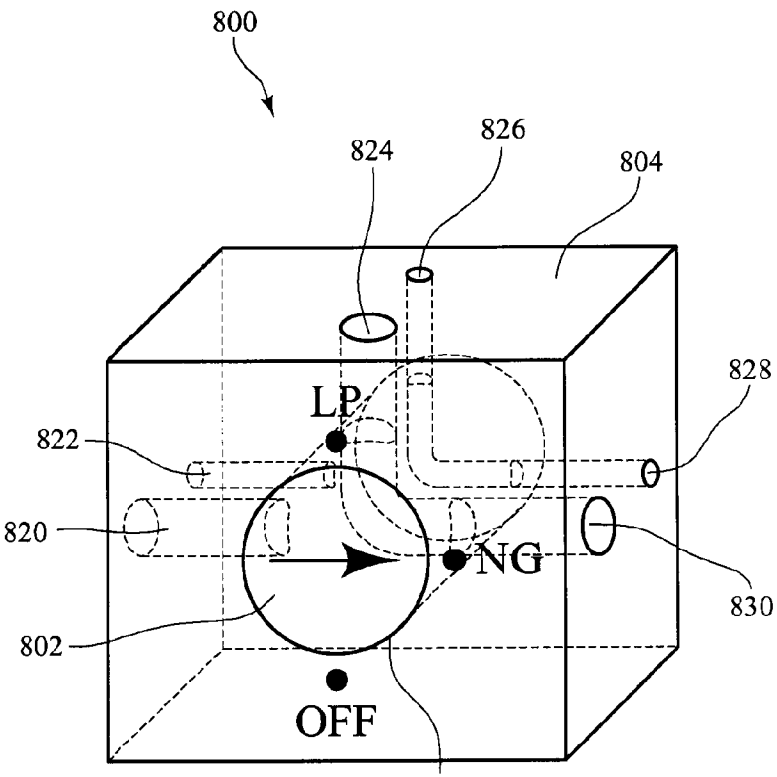
FIG. 8 is a blow-up view of the multi-positional manual control valve of FIG. 7.
Figure 8A:
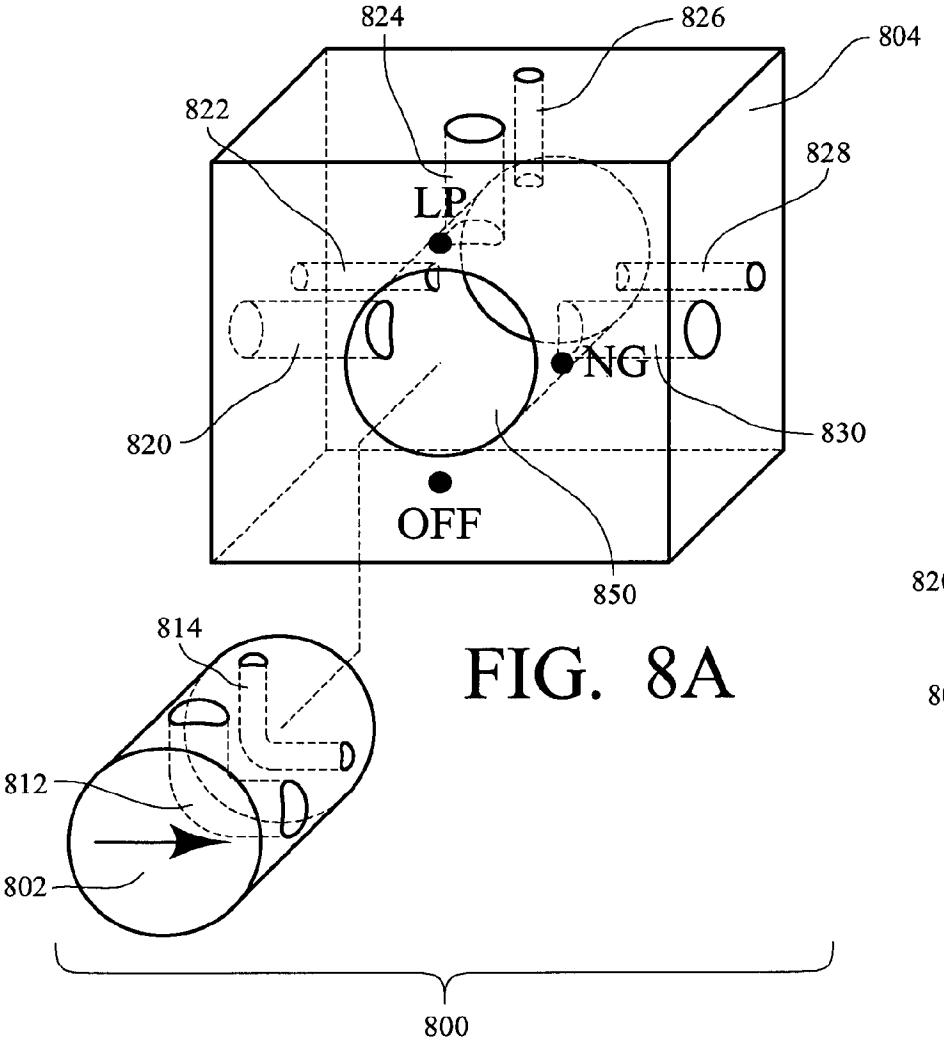

FIGS. 8A and 8B show a blow-up view of multi-positional manual control valve 800. Multi-positional manual control valve 800 comprises a control block 804 and a control cylinder 802. Control block 804 has a cylindrical aperture 850 extending from a front surface to a rear surface. The front surface of control 800 has fuel selection and cut off indicators LP, NG, and OFF. Three fuel injector apertures 820, 824 and 830 extend from cylindrical aperture 850 at about 90° intervals to a left side, top, and right side of control block 804. A pilot aperture is axially aligned about cylindrical aperture 850 with each fuel injector aperture, pilot aperture 822 is axial aligned with injector aperture 820, pilot aperture 826 is axial aligned with injector aperture 824, and pilot aperture 828 is axial aligned with injector aperture 830. Control cylinder 802 has an outer circumference proximate the circumference of cylindrical aperture 850 in control block 804 wherein control cylinder 802 is closely received within. Control cylinder 802 has "L" shaped flow through fuel injector aperture 812 and an axially aligned "L" shaped flow through pilot aperture 814. Control cylinder 802 has a first, second, and third, position within the cylindrical aperture in control block 804. The front surface of control cylinder 802 has a selection arrow pointing to an appropriate indicator on the front surface of control block 804. At a first position, fuel injector aperture 820 and pilot aperture 822 are in flow communication with fuel injector aperture 824 and pilot aperture 826. At a second position, as shown in FIG. 8B, fuel injector aperture 824 and pilot aperture 826 are in flow communication with fuel injector aperture 830 and pilot aperture 828. At the third position, one end of the "L" shaped flow through fuel injector aperture 812 and axially aligned "L" shaped flow through pilot aperture 814 are blocked by the wall of cylindrical aperture 850 in control block 804 cutting off the flow of fuel.

Figure 9:
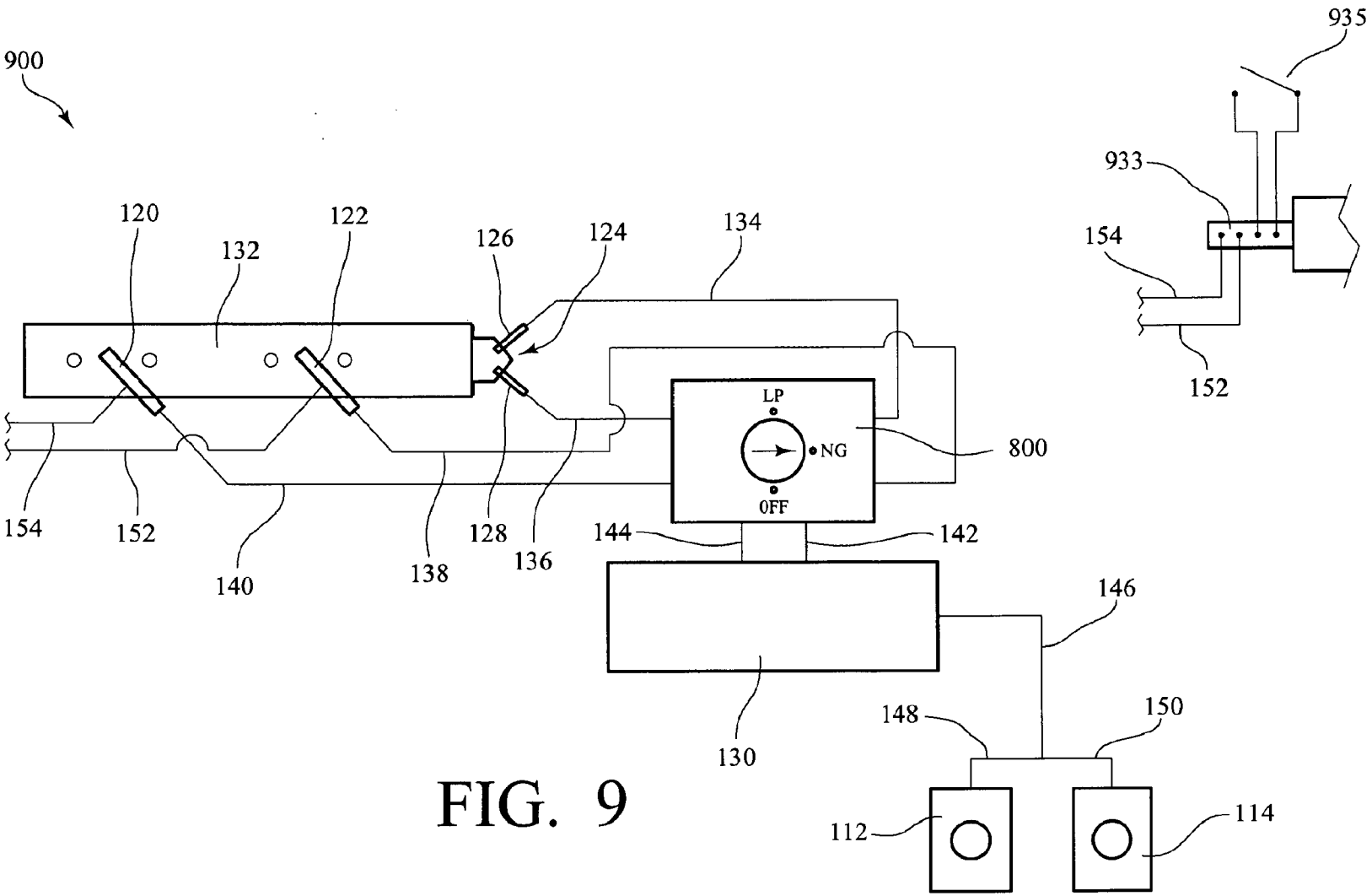
FIG. 9 is a schematic view of a dual fuel vent free heater having a multi-positional manual control valve, a thermal switch, a thermostatic control valve, and pilot burners aligned on a similar side of a burner.

FIG. 9 shows a schematic view of dual fuel vent free heater 900. Dual fuel gas heater 900 comprises two regulators 112 and 114 in flow communication with a "T" connector via fuel lines 148 and 150. Fuel line 146 extends from the "T" connector to thermostatic control valve 130. A pilot line 142 and an injector line 144 lead from thermostatic control valve 130 to multi-positional manual control valve 800. Multi-positional manual control valve 800 has a first, second, and third control position as indicated with LP, NG, and OFF. The first control position creates a flow communication between the pilot line 144 and injector line 142 leading from thermostatic control valve 130 with pilot flame burner 120 and injector 128 through pilot feed line 140 and injector feed line 136 respectively. The second control position creates a flow communication between pilot line 144 and injector line 142 leading from thermostatic control valve 130 with pilot flame burner 122 and injector 126 respectively. The third position cuts off fuel flow from pilot line 144 and injector line 142 leading from thermostatic control valve 130. Thermal switch 935 is in electrical communication with a temperature sensor proximate pilot flame burners 120 and 122 and primary burner 132 as shown via electrical connectors 154 and 152 respectively through thermo control block (T/C block) 933. Thermal switch 935 sends a shut off signal to a control valve 130 when a first set temperature is exceeded in 132 indicating a wrong fuel setting and cutting off the flow of fuel to heater 900. In an embodiment incorporating this safety shut-off feature shutting off fuel flow to the gas heater in the event a set temperature is exceeded and the safety shut-off feature shown in FIG. 2 and previously described, shutting off fuel flow to the gas heater in the event a set temperature is more than a set control temperature, provides complete fuel shut-off functionality.

Figure 10:
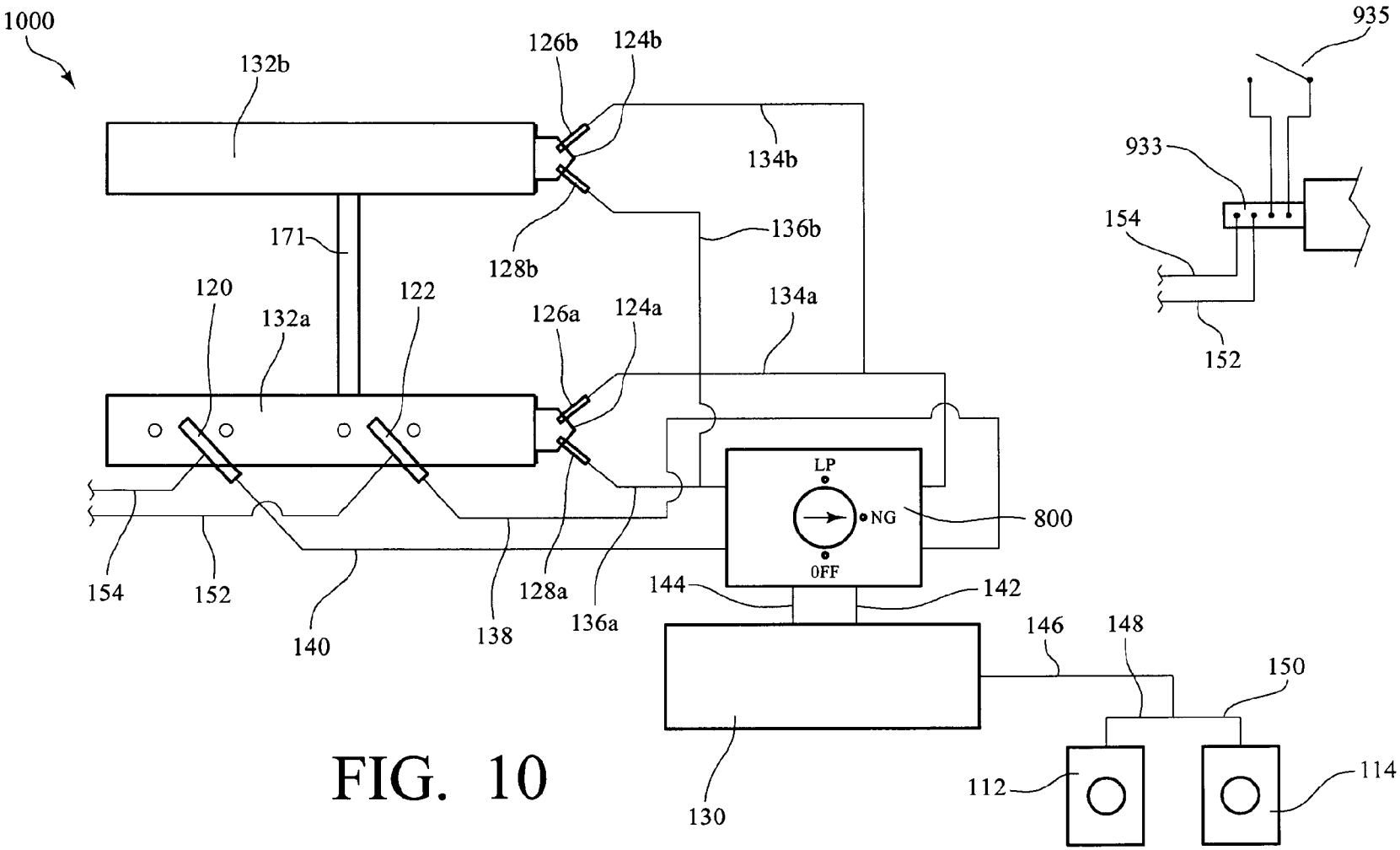
FIG. 10 is schematic view of the dual fuel vent free heater having a first burner, a second burner, and a cross-over burner for use in a vent free fireplace unit.

FIG. 10 shows a schematic view of dual fuel vent free heater 1000 having burner 132*a*, 132*b*, and cross-over burner 171. Such a configuration provides a blue flame burner and a yellow flame burner as is often desirable in a vent free fireplace heater. The configuration of heater 1000 is similar to the configuration of heater 900 with the addition of burners 132*b*, cross-over burner 171, two fuel line "T" connectors, and fuel injectors 126*b* and 128*b*. Crossover burner 171 is in flow communication with burners 132*a* and 132*b*. Burner 132*b* has fuel injectors 126*b* and 128*b* held by bracket 124*b* proximate an axial end and is situated substantially parallel burner 132*a*. Fuel supply line 134*b* feeds injector 126*b* with a "T" connector in flow communication with fuel supply line 134*a*. Fuel supply line 136*b* feeds injector 128*b* with a "T" connector in flow communication with fuel supply line 136*a*. The statement: "Two burners or parts of burners that are in flow communication with each other" implies either that there is an opening or a connection between the two burners that allows a gas to flow from one to the other, or that some of the openings in each burner are in close proximity with each other to allow the burning gasses from one burner to ignite the gasses emanating from the other.

Figure 11:
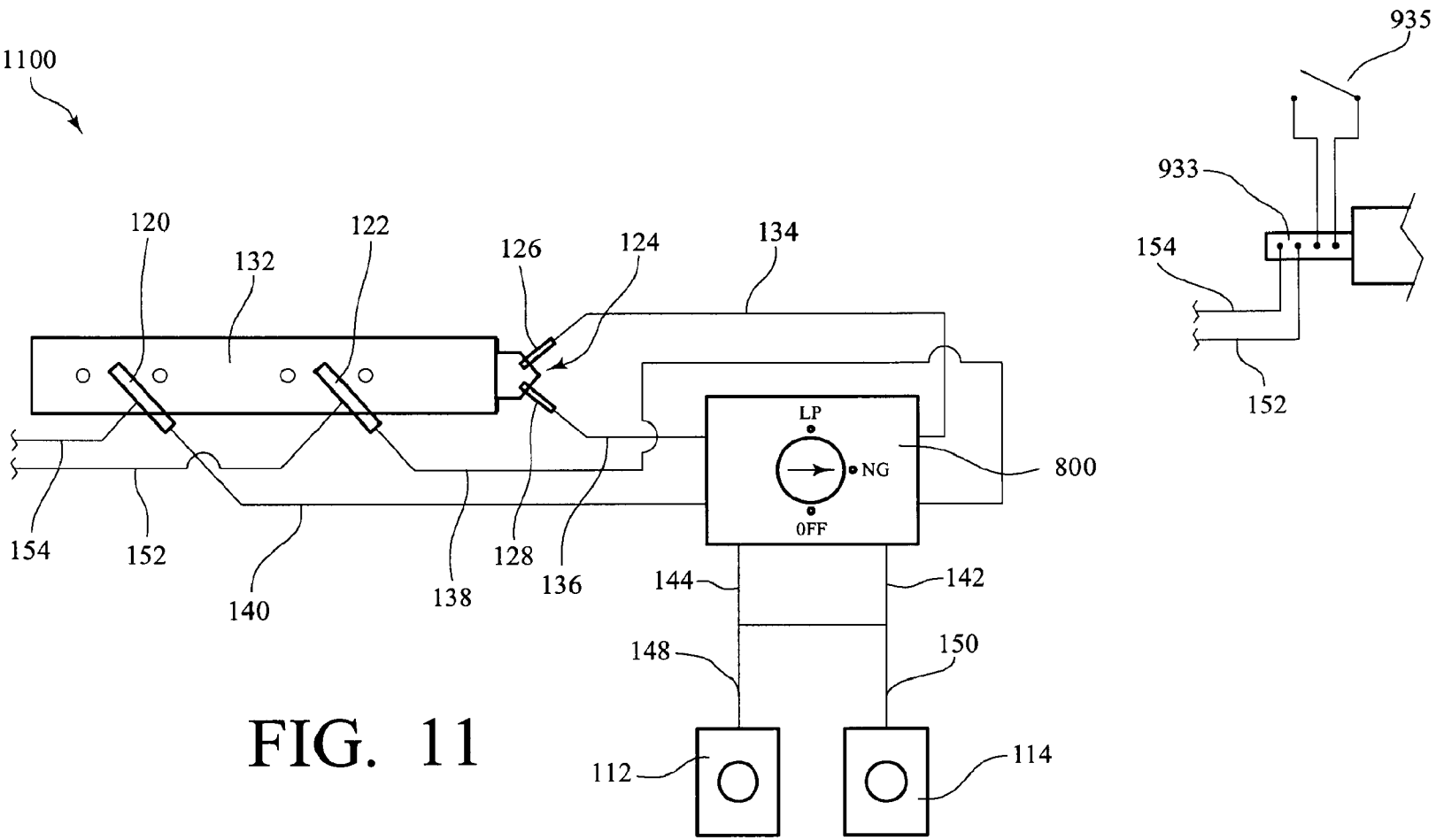
FIG. 11 is a schematic view of a dual fuel vent free heater having a multi-positional manual control valve directly controlling the flow of fuel into the heater.

FIG. 11 is a schematic view of dual fuel vent free heater 1100 having a multi-positional manual control valve 800 directly controlling the flow of fuel into heater 1100. The configuration of heater 1100 is similar to that of heater 900 but does not have thermostatic control 130. Rather, fuel from either regulator 112 or regulator 114 is fed through fuel line 148 or 150. Fuel lines 148 and 150 "T" into pilot line 142 and injector line 144 which lead directly to multi-positional manual control valve 800. Therefore, the amount of heat produced by heater 1100 is manually controlled with multi-positional manual control valve 800 without any thermostatic control.

The invention claimed is:

1. A dual fuel vent free gas heater comprising:

two regulators arranged in parallel flow paths and in flow communication with a fuel line extending to a thermostatic control valve; the thermostatic control valve having an injector fuel outlet line feeding a multi-positional manual fuel control valve, said multi-positional manual control valve comprising a control block with a single control cylinder that is rotatable between a first angular position to feed a first injector fuel supply line or second angular position to feed a second injector fuel supply line;

a gas burner having a plurality of gas outlet ports, said plurality of gas outlet ports being in flow communication with at least a first pilot flame burner;

a first and a second fuel injector, said first fuel injector being in flow communication with the first injector fuel supply line and said second fuel injector being in flow communication with the second injector fuel supply line, said first and second fuel injectors being in flow communication with an interior of said gas burner via a gas burner inlet, said first and said second fuel injectors each having an injection angle with respect to the gas burner inlet other than 0°; and said first injector fuel supply lines and said first injectors each having a composition and configuration for transporting a first type of fuel at desired flow rates, said second injector fuel supply line and said second injector each having a composition and configuration for transporting a second type of fuel at desired flow rates, said first type of fuel being different from said second type of fuel.

2. The dual fuel gas heater of claim 1 further comprising an oxygen detection system, said oxygen detection system having a temperature sensor in proximity to said first pilot flame burner.

3. The dual fuel gas heater of claim 2 wherein said first type of fuel is fed through the first regulator and said second type of fuel is fed through the second regulator, said thermostat control valve electrically coupled to the temperature sensor and configured to shut off the flow of fuel to the injector fuel outlet line feeding the multi-positional manual fuel control valve upon receiving a shut off signal from the temperature sensor.

4. The dual fuel gas heater of claim 1 having an igniter in flow communication with said first pilot flame burner.

5. The dual fuel gas heater of claim 1 wherein said first type of fuel is natural gas and said second type of fuel is liquid propane gas.

6. The dual fuel gas heater of claim 1 wherein the thermostatic control valve has a pilot burner fuel outlet line and said plurality of gas outlet ports of said gas burner are in flow communication with said first pilot flame burner and a second pilot flame burner; said control block of said multi-positional valve having a cylindrical aperture, the cylindrical aperture having a first, second and third fuel injector apertures extending from said cylindrical aperture at about 90° intervals to a first, second and third sides of said control block, respectively, a first, second and third pilot aperture is axially aligned about said cylindrical aperture with each of said first, second and third fuel injector apertures, respectively, said control cylinder having a circumference proximate the circumference of said cylindrical aperture wherein said control cylinder is closely received within said cylindrical aperture, said control cylinder having an "L" shaped flow through fuel injector aperture and an axially aligned "L" shaped flow through pilot aperture, said control cylinder rotatable between the first angular position and the second angular position within said cylindrical aperture in said control block, at said first angular position said first fuel injector aperture and said first pilot aperture extending to said first side of said control block are in flow communication with said third fuel injector aperture and said third pilot aperture extending to said third side of said control block, at said second angular position said second fuel injector aperture and said second pilot aperture extending to said second side of said control block are in flow communication with said third fuel injector aperture and said third pilot aperture extending to said third side of said control block, the first fuel injector aperture coupled to the first injector fuel supply line, the first pilot aperture coupled to a first pilot flame burner supply line leading to the first pilot flame burner, the second fuel injector aperture coupled to the second fuel supply line, the second pilot aperture coupled to a second pilot flame burner supply line leading to the second pilot flame burner, the third fuel injector aperture coupled to the injector fuel outlet line of the thermostatic control valve, the third pilot aperture coupled to the pilot fuel outlet line of the thermostatic control valve.

7. A dual fuel gas heater comprising:

two regulators in flow communication with a thermostatic control valve;

a pilot line and an injector line leading from said thermostatic control valve to a multi-positional manual control valve;

said multi-positional manual control valve having a first, second, and third control position, said first control position creating a flow communication between said pilot line and injector line leading from said thermostatic control valve with a first pilot flame burner and a first injector respectively, said second control position creating a flow communication between said pilot line and injector line leading from said thermostatic control valve with a second pilot flame burner and a second injector respectively, said third position cutting off fuel flow from said pilot line and injector line leading from said thermostatic control valve a first and second pilot line leading from said control valve to a first and second pilot flame burner;

a first burner having said first and second pilot flame burners proximate gas outlet apertures and said first and second injectors proximate an axial opening; and a thermal switch being in electrical communication with a temperature sensor proximate each of said pilot flame burners and with said thermostatic control valve, said thermal switch sends a shut off signal to said thermostatic control valve when a first set temperature is exceeded in said first pilot flame burner or a second set temperature is exceeded in said second pilot flame burner.

8. The dual fuel heater of claim 7 wherein said first and said second pilot flame burners are proximate a first side of said burner.

9. The dual fuel heater of claim 7 wherein said first pilot flame burner is proximate a first side of said burner and said second pilot flame burner is proximate a second side of said burner.

10. A dual fuel gas heater comprising:

a gas burner having a plurality of gas outlet ports, said plurality of gas outlet ports being in flow communication with a first pilot flame burner and a second pilot flame burner, a first and a second fuel injector, said first and second fuel injectors being in flow communication with an interior of said gas burner via a gas burner inlet; and a first regulator and a second regulator arranged in parallel flow paths and in flow communication with a fuel line extending to a thermostatic control valve, the first regulator configured for delivering a first type of fuel, the second regulator configured for delivering a second type of fuel; the thermostatic control valve having an injector fuel outlet line and a pilot burner fuel outlet line feeding a multi-positional fuel control valve, said multi-positional manual control valve comprising a control block with a single control cylinder that is rotatable between a first angular position to feed a first injector fuel supply line and a first pilot burner fuel supply line and a second angular position to feed a second injector fuel supply line and a second pilot burner supply line;

said first injector fuel supply line and the first pilot burner fuel supply line each having a composition and configuration for transporting the first type of fuel at desired flow rates, said second injector fuel supply line and the second pilot burner fuel supply line each having a composition and configuration for transporting the second type of fuel at a desired flow rate, said control block of said multi-positional control valve having a cylindrical aperture, the cylindrical aperture having a first, second and third fuel injector apertures extending from said cylindrical aperture to a first, second and third side of said control block, respectively, a first, second and third pilot aperture is axially aligned about said cylindrical aperture with each of said first, second and third fuel injector apertures, respectively, said control cylinder having a circumference proximate the circumference of said cylindrical aperture wherein said control cylinder is closely received within said cylindrical aperture, said control cylinder having an "L" shaped flow through fuel injector aperture and an axially aligned "L" shaped flow through pilot aperture, said control cylinder rotatable between the first angular position and the second angular position within said cylindrical aperture in said control block, at said first angular position said first fuel injector aperture and said first pilot aperture extending to said first side of said control block are in flow communication with said third fuel injector aperture and said third pilot aperture extending to said third side of said control block, at said second angular position said second fuel injector aperture and said second pilot aperture extending to said second side of said control block are in flow communication with said third fuel injector aperture and said third pilot aperture extending to said third side of said control block, the first fuel injector aperture coupled to the first injector fuel supply line, the first pilot aperture coupled to the first pilot burner fuel supply line, the second fuel injector aperture coupled to the second fuel injector supply line, the second pilot aperture coupled to the second pilot burner fuel supply line, the third fuel injector aperture coupled to the injector fuel outlet line of the thermostatic control valve, the third pilot aperture coupled to the pilot fuel outlet line of the thermostatic control valve.

11. The dual fuel gas heater of claim 10 further comprising an oxygen detection system, said oxygen detection system having a temperature sensor in proximity to one or both of said first and second pilot flame burners.

12. The dual fuel gas heater of claim 11 wherein said thermostat control valve is electrically coupled to the temperature sensor and configured to shut off the flow of fuel to the injector fuel outlet line and the pilot burner fuel outlet line upon receiving a shut off signal from the temperature sensor.

13. The dual fuel gas heater of claim 10 wherein said first type of fuel is natural gas and said second type of fuel is liquid propane gas.

* * * * *